US008951063B2

(12) United States Patent
Iio

(10) Patent No.: US 8,951,063 B2
(45) Date of Patent: Feb. 10, 2015

(54) CRIMP TERMINAL

(71) Applicant: Sumitomo Wiring Systems, Ltd., Yokkaichi, Mie (JP)

(72) Inventor: Kiyokazu Iio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 31 days.

(21) Appl. No.: 13/873,652

(22) Filed: Apr. 30, 2013

(65) Prior Publication Data

US 2013/0309903 A1 Nov. 21, 2013

(30) Foreign Application Priority Data

May 15, 2012 (JP) ..... 2012-111445

(51) Int. Cl.

| | |
|---|---|
| ***H01R 13/52*** | (2006.01) |
| ***H01R 4/18*** | (2006.01) |
| *H01R 4/72* | (2006.01) |
| *H01R 4/70* | (2006.01) |

(52) U.S. Cl.

CPC ..... *H01R 13/5216* (2013.01); *H01R 4/185* (2013.01); *H01R 4/72* (2013.01); *H01R 4/70* (2013.01); *Y10S 439/932* (2013.01)

USPC ..... 439/523; 439/877; 439/932; 439/730

(58) Field of Classification Search

USPC ..... 439/523, 730, 877, 932; 174/DIG. 8

See application file for complete search history.

(56) References Cited

U.S. PATENT DOCUMENTS

| | | | | |
|---|---|---|---|---|
| 3,708,611 | A * | 1/1973 | Dinger | 174/84 C |
| 5,385,492 | A * | 1/1995 | Stuart | 439/877 |
| 6,666,732 | B1 * | 12/2003 | Endacott | 439/874 |
| 7,094,098 | B2 * | 8/2006 | Miyazaki | 439/559 |
| 7,364,478 | B2 * | 4/2008 | Xu | 439/874 |
| 7,722,382 | B2 * | 5/2010 | Landis et al. | 439/393 |

FOREIGN PATENT DOCUMENTS

| | | |
|---|---|---|
| JP | 5-8871 | 2/1993 |
| JP | 5-31130 | 4/1993 |
| JP | 5-31131 | 4/1993 |
| JP | 10-289745 | 10/1998 |
| JP | 2000-182688 | 6/2000 |
| JP | 2008-176970 | 7/2008 |
| JP | 2009-230998 | 10/2009 |

* cited by examiner

*Primary Examiner* — Dac D Ta
*Assistant Examiner* — Travis Chambers
(74) *Attorney, Agent, or Firm* — Gerald E. Hespos; Michael J. Porco; Matthew T. Hespos

(57) ABSTRACT

A crimp terminal (10) has a connecting portion (12) that is conductively connected to an electrical connection target, a crimp portion (14) that has a core crimping portion (22) that is fixed by crimping to a core (38) of a coated wire (32), and a link (16) that extends between the connecting portion (12) and the crimp portion (14), a positioning protrusion (30) is formed by a pair of slits (26) penetrating through the link (16) and extending in a direction along which the link (16) so as to be separated from each other in a width direction orthogonal to the extension direction. An intermediate region (28) sandwiched between the slits (26) in the width direction is deformed to protrude on a side on which the core crimping portion (22) protrudes.

11 Claims, 3 Drawing Sheets

CRIMP TERMINAL

BACKGROUND OF THE INVENTION

1. Field of the Invention

The invention relates to a crimp terminal that is attached by crimping to an exposed core at the end of a coated wire.

2. Description of the Related Art

Crimp terminals that are crimped to an exposed core at the end of a coated wire have been employed widely with coated wires that are used in the electrical systems of cars and the like. JP 5-31130A discloses such crimp terminals that have a connecting portion formed from a conductive member, such as a metal, and conductively connected to an electrical connection target, a crimp portion having a core crimping portion that is fixed by crimping to an outer peripheral surface of the core of the coated wire, and a link that extends therebetween. To ensure the waterproofness of the section of the crimp terminal attached to the coated wire, the crimp portion and the core are covered in a sealed state, by inserting a heat shrinkable tube containing hot-melt adhesive over a peripheral region that includes the crimp portion and heat shrinking the heat shrinkable tube, or sealing a peripheral region of the crimp portion using a cylindrical molded component of a synthetic resin material.

The core needs to contact the crimp portion over a sufficient area to ensure reliable conduction between the crimp terminal and the coated wire. Also, the crimp portion and the core need to be reliably covered with a covering cylindrical body such as the heat shrinkable tube or the molded component to ensure reliable waterproofness of the crimp portion. In view of this, JP 5-31130A proposes forming a large notch in a central section of the link between the connecting portion and the crimp portion, and an upward protuberance is formed by bending the notched section up on the side on which the core crimping portion protrudes. The core of the coated wire can be inserted into the crimp portion until the core abuts the upward protuberance thereby ensuring sufficient contact between the crimp portion and the core. Also, the covering cylindrical body by inserting the covering cylindrical body moved to a position beyond the upward protuberance to cover the crimp portion and the core reliably.

However, the above-described structure created the potential for insufficient rigidity of the link. More particularly, external force caused by interference with other members, vibrations and the like is concentrated on the link between the connecting portion, which is the fixing point to the connection target, and the crimp portion, which is the fixing point to the coated wire when the crimp terminal is connected to a connection target. Thus a large bending force is applied to the link. With a crimp terminal having a conventional structure, a large notch must be provided in this link to form the upward protuberance. As a result the connecting portion and the crimp portion are connected only by edge portions of the link. Hence, it was difficult to ensure sufficient rigidity of the link, leading to problems such as durability deterioration and breakage of the link.

The upward protuberance is only about the size of the plate thickness of the crimp terminal. Thus, it was difficult to ensure sufficient coverage of the core by the heat shrinkable tube, in the case where one of the sides sandwiching the upward protuberance was used for positioning the core and the other side was used for positioning the heat shrinkable tube. Accordingly, there was a risk of the core being exposed simply by the heat shrinkable tube coming loose and shifting due to the high temperature environment in a vehicle. Therefore, the conventional upward protuberance was not sufficient to realize adequate positioning of the core and the heat shrinkable tube to guarantee waterproofness.

The invention was made in view of the abovementioned circumstances, and has as an object to provide a crimp terminal that can realize stable positioning of a core and a covering cylindrical body while ensuring the rigidity of a link.

SUMMARY OF THE INVENTION

The invention is a crimp terminal with a connecting portion that is to be connected conductively to an electrical connection target, a crimp portion that has a core crimping portion that is fixed by crimping to a core of a coated wire, and a link that extends between the connecting portion and the crimp portion. Two slits are formed in the link and extend in a direction along which the link extends. The slits are separated from each other in a width direction orthogonal to the extension direction and pass through the link in a thickness direction of the link. An intermediate region sandwiched between the slits in the width direction is deformed to protrude on a side on which the core crimping portion protrudes, thereby forming a positioning protrusion.

According to this aspect of the invention, rather than providing a large notch in the link of the crimp terminal and providing an upward protuberance for positioning the core through a cutting and bending process, the positioning protrusion can be provided by providing two slits extending in the direction in which the link portion extends and deforming an intermediate region sandwiched between the slits to protrude. The positioning protrusion thus can be formed without providing a large separated section in the link. More particularly, both ends of the positioning protrusion remain unitary with the link at the connecting portion side and the crimp portion side. Therefore, sufficient strength of the link can be ensured, compared to the conventional structure in which a large separated section is formed in the link. Hence, even in the case where a large bending force is exerted on the link of the crimp terminal, sufficient rigidity can be ensured, and the possibility of problems such as breakage can be reduced or eliminated.

The slits extend in the extension direction of the link. Thus, the positioning protrusion deformed to protrude can be arranged to span a predetermined distance in the extension direction of the link, compared to a projecting piece that has been cut and bent like the conventional structure. Hence, a sufficient separation distance between both positioning portions can be ensured even when using the crimp portion side of the positioning protrusion as a core positioning portion and abutting the core thereagainst, and using the connecting portion side of the positioning protrusion as a positioning portion of a covering cylindrical body, such as a heat shrinkable tube. Therefore, a stable positional relationship is assured between the core position and the covering cylindrical body.

An opening is provided in the intermediate region of the link, by deforming the intermediate region between the slits to protrude on the side on which the crimp portion protrudes. Hot-melt adhesive melted at the time of heat compression of the heat shrinkable tube can be accommodated in the opening, and outflow to the connecting portion side advantageously can be avoided.

The shape of the positioning protrusion is not limited as long as it is deformed to protrude on the side on which the crimp portion protrudes. Thus, the positioning protrusion can have a peaked shape, a curved shape, a rectangular shape or a right-triangular shape in side view. For example, a shape that facilitates visual checking can be employed, depending on the required positional relationship of the core and the end portion of a covering cylindrical body, such as a heat shrinkable tube.

The positioning protrusion in the crimp terminal preferably has a peaked shape that protrudes most in a central section in the lengthwise direction. Stress advantageously is distributed when both ends of the positioning protrusion that are joined to the connecting portion and the crimp portion are deformed and the durability of the crimp terminal can be improved. Also, the central position of the positioning protrusion is checked easily, and the core and an end portion of the covering cylindrical body advantageously can be positioned on the basis of the central position.

DETAILED DESCRIPTION OF THE PREFERRED EMBODIMENTS

Figure 1:
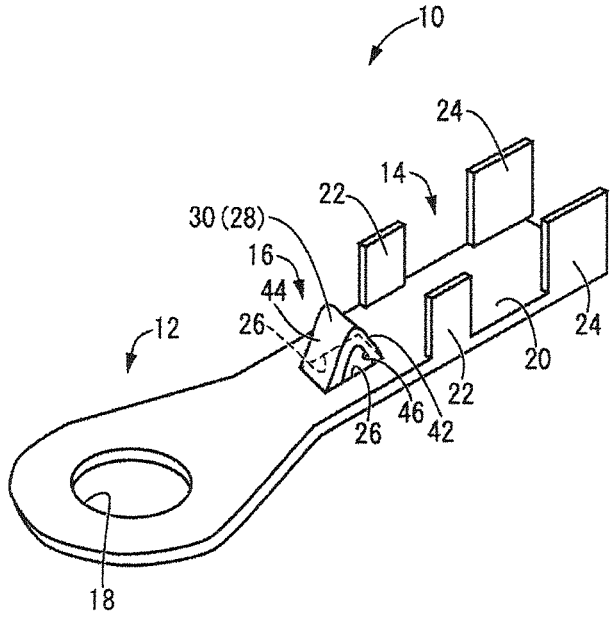
FIG. 1 is a perspective view of a crimp terminal serving as one embodiment of the present invention.

A crimp terminal 10 in accordance with an embodiment of the invention is identified by the numeral 10 in FIG. 1. The crimp terminal 10 is formed unitarily to include a connecting portion 12 that is connected conductively to an electrical connection target, a crimp portion 14 having core crimping portions 22 that are fixed by crimping to a core 34 of a coated wire 32, and a link 16 that extends therebetween.

The crimp terminal 10 has conductivity and is formed using various metal materials including brass, copper, copper alloy, aluminum and aluminum alloy, for example, capable of undergoing processing such as pressing and punching. In the present embodiment, the thickness dimension of the crimp terminal 10 is approximately constant throughout its entirety.

The plane of the connecting portion 12 has an approximately elliptical planer shape, and a through hole 18 passes through a central section thereof. The through hole 18 is utilized to insert a fastening bolt that is screwed into a predetermined position.

The crimp portion 14 includes a placement panel 20 having a long approximately rectangular planar shape, two core crimping portions 22 and two coated wire crimping portions 24 are provided on opposite sides in the width direction of the placement portion 20. The core crimping portions 22 and coated wire crimping portions 24 are formed from projecting pieces having an approximately rectangular planar shape that protrude from the sides in the width direction of the placement panel 20. These projecting pieces are bent to one surface side (up in FIG. 1) of the placement panel 20, and constitute walls on both sides of the placement panel 20.

The link 16 between the connecting portion 12 and the crimp portion 14 has two slits 26 extending in the extension direction. The slits 26 are separated from each other in a width direction orthogonal to the extension direction and pass through in a thickness direction of the link 16. A positioning protrusion 30 is formed by an intermediate region 28 sandwiched between the two slits 26 in the width direction is deformed to protrude on the side on which the core crimping portions 22 of the crimp portion 14 protrude (upper surface side in FIG. 1). More particularly, both ends in the lengthwise direction of the positioning protrusion 30 are deformed to protrude while remaining joined unitarily to the link 16. The positioning protrusion 30 can thereby be formed while retaining the rigidity of the link 16. Note that, in the present embodiment, the positioning protrusion 30 protrudes most in a central section in the lengthwise direction, and has a peaked shape in side view.

Figure 2:
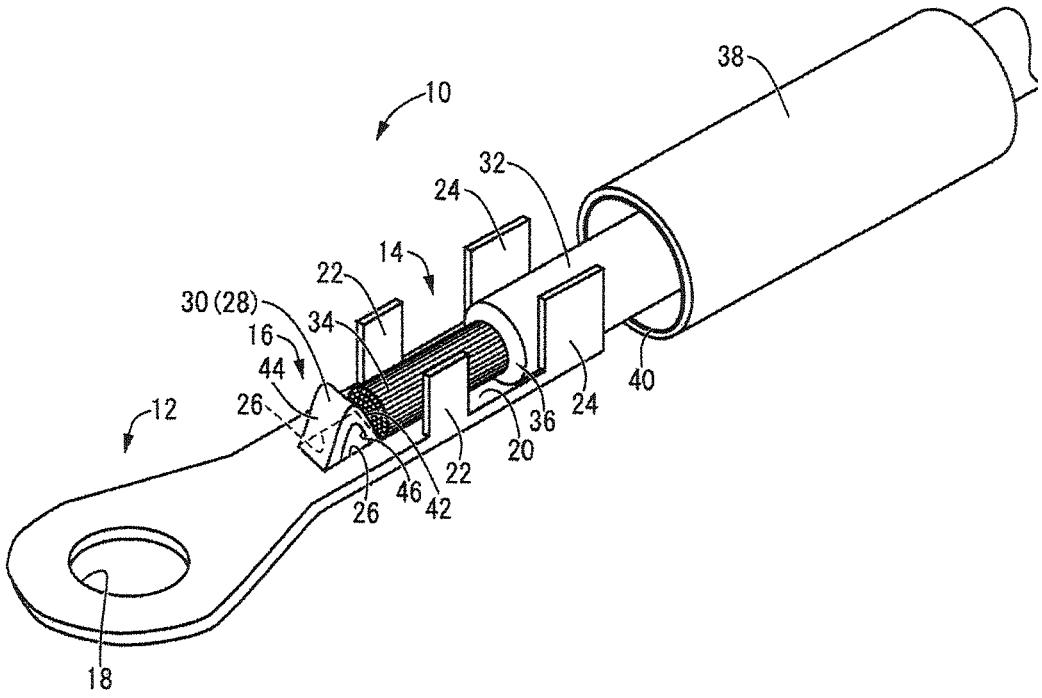
FIG. 2 is a perspective view of an electrical wire with a heat shrinkable tube in which the crimp terminal shown in FIG. 1 is inserted.

As shown in FIG. 2, the coated wire 32 has a core 34 formed by bundling a plurality of copper, aluminum and other metal wires that serves as a conductor. The core 34 is covered with an insulation sheath 36 made of ethylene resin, styrene resin or the like having electrical insulation properties. First, the insulation sheath 36 at the tip of the coated wire 32 is stripped to expose the core 34. Next, a heat shrinkable tube 38 is movably inserted over the outer periphery of the coated wire 32.

The tip section of the coated wire 32 at which the core 34 is exposed is placed on the upper surface of the placement panel 20 in the crimp portion 14 of the crimp terminal 10. At this point, the tip of the core 34 is abutted against a crimp portion-side surface 42 of the positioning protrusion 30 to position the coated wire 32 properly on the placement panel 20. The core 34 exposed between the pair of the core crimping portions 22 can thereby be arranged simply and accurately, and the section covered with the insulation sheath 36 can be arranged between the pair of coated wire crimping portions 24.

Figure 3:
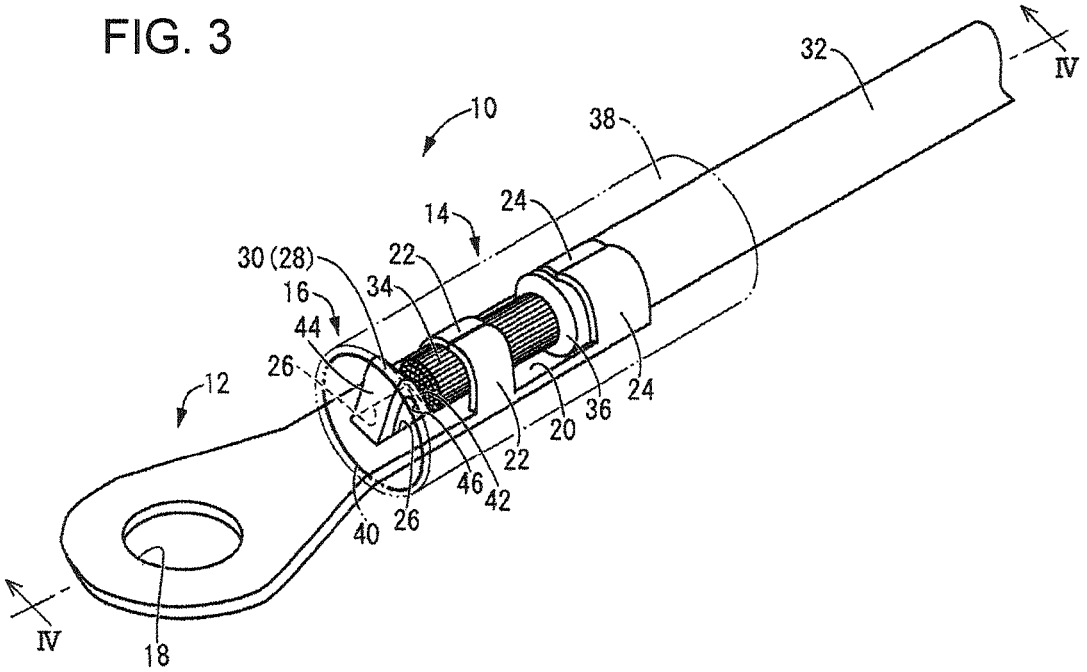
FIG. 3 is a perspective view of an electrical wire with a heat shrinkable tube to which the crimp terminal shown in FIG. 1 is attached.

In this state, crimping is performed on the core crimping portions 22 and the coated wire crimping portions 24, using a well-known crimping device such as shown in JP 05-23389A, for example. The crimp portion 14 provided with the core crimping portions 22 and the coated wire crimping portions 24 is thereby plastically deformed and crimped to wrap around the outer peripheral surface of the core 34 and the coated wire 32, as shown in FIG. 3. The inner surface of the crimp portion 14 will thereby be abutted against the outermost peripheral surface of the core 34 and the coated wire 32 in a crimped state. Note that, in this state, the core 34 remains exposed.

Next, the heat shrinkable tube 38 is slid along the coated wire 32, and, as shown in FIG. 3, the tip of the heat shrinkable tube 38 is positioned with the end portion of a connecting portion-side surface 44 of the positioning protrusion 30 as a marker. At this point, the heat shrinkable tube 38 is positioned away from the tip portion of the core 34 in the coated wire 32 by a dimension L1 in the lengthwise direction of the positioning protrusion 30 (see FIG. 4). Given that this dimension L1 is sufficiently longer than the extended length L2 of the core 34 from the core crimping portion 22, for example, the core 34 can be covered by the heat shrinkable tube 38 with sufficient coverage L1. In this state, the heat shrinkable tube 38 is heated using heating means, such as an electric heater.

Figure 4:
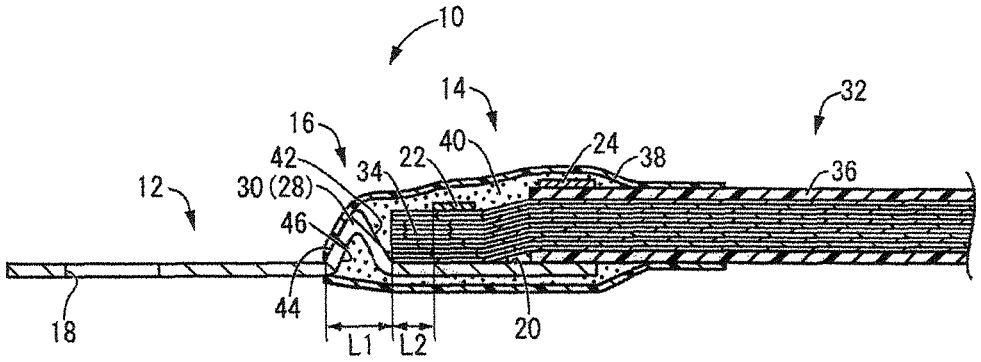
FIG. 4 is a cross-sectional view sectioned along IV-IV in FIG. 3, in a state where the heat shrinkable tube is covering.

As shown in FIG. 4, the heat shrinkable tube 38 is thereby heat shrunk and constricts around the tip portion of the coated wire 32 as well as the placement panel 20. A hot-melt adhesive 40 melted as a result of the heating adheres a section of the core 34 from the positioning protrusion 30, the core crimping portions 22 and coated wire crimping portions 24, and a rear end portion of the placement panel 20 due to the shrink force of the heat shrinkable tube 38. Moreover, because the hot-melt adhesive 40 melted by the heating loses viscosity and fluidizes, the space between the abovementioned members can be completely filled without leaving any large gaps, and the abovementioned members can be adhered in a liquid-tight state.

Some of the melted hot-melt adhesive 40 may attempt to flow toward the connecting portion 12 side from the front end of the heat shrinkable tube 38, any outflow will be prevented by the positioning protrusion 30. Thus, the space can be filled with the hot-melt adhesive 40, without any voids being formed not only around the outer peripheral surface of the core 34, but also between the positioning protrusion 30 and the front end surface of the core 34. Accordingly, the protruding height of the positioning protrusion 30 from the placement panel 20 desirably is approximately the same or greater than the diameter of the core 34.

Also, an opening 46 is provided in the bottom surface of the positioning protrusion 30. The hot-melt adhesive 40 melted at the time of heat compression of the heat shrinkable tube 38 flows into this opening 46, and outflow to the connecting portion 12 side advantageously can be avoided.

Furthermore, even supposing that some of the hot-melt adhesive 40 does flow beyond the positioning protrusion 30, the amount of outflows will be minimal, and it will cool and harden on the link 16, without flowing beyond the link 16 and reaching the connecting portion 12.

As mentioned above, using the crimp terminal 10 of the present embodiment enables the core 34 section of the coated wire 32 placed on the placement panel 20 to be sealed from the outside and covered over by the heat shrinkable tube 38 and the hot-melt adhesive 40, without being exposed to the outside. Also, the melted hot-melt adhesive 40 advantageously can be prevented from flowing onto the connecting portion 12 by the positioning protrusion 30, and the occurrence of a bad connection caused by the hot-melt adhesive 40 adhering to the connecting portion 12 can be prevented.

The invention does not require a large notch in the link 16 of the crimp terminal 10 and does not have an upward protuberance formed through a cutting and bending process. Rather, the positioning protrusion 30 can be formed by providing two slits 26 extending in the extension direction of the link 16 and deforming the intermediate region 28 sandwiched between these slits 26 to protrude. Accordingly, as shown in FIG. 4, given that both end portions of the positioning protrusion 30 remain linked unitarily on the connecting portion 12 side and crimp portion 14 side, sufficient strength of the link 16 is ensured, compared to the conventional structure in which a large separated section was formed in the link.

Also, given that the two slits 26 extend in the extension direction of the link 16, the positioning protrusion 30 deformed to protrude can be arranged to span a predetermined distance in the extension direction of the link 16, compared to a projecting piece that has been cut and bent like the conventional structure. Hence, by using the crimp portion-side surface 42 of the positioning protrusion 30 as a core positioning portion and abutting the core 34 thereagainst, and using the connecting portion-side surface 44 of the positioning protrusion 30 as a positioning portion of a covering cylindrical body, such as the heat shrinkable tube 38, a sufficient separation distance between both positioning portions can be ensured. Hence, the core 34 can be covered by the covering cylindrical body with sufficient coverage, enabling reliable waterproofness of the core 34 to be ensured.

The positioning protrusion 30 is formed into a peaked shape that protrudes most in a central section in the lengthwise direction. Thus, stress is distributed when ends of the positioning protrusion 30 joined to the connecting portion 12 and the crimp portion 14 are deformed, and the durability of the crimp terminal 10 can be improved. Furthermore, the central position of the positioning protrusion 30 is checked easily, and the core 34 and the end portion of the covering cylindrical body can be positioned advantageously on the basis of this central position.

Although an embodiment of the invention has been described above, the present invention is not limited in any way by the specific description in the embodiment. For example, the shape of the positioning protrusion 30 is not limited as long as it is deformed to protrude on the side on which the crimp portion 14 protrudes, and other shapes can be employed, such as the peaked shape, a curved shape, a rectangular shape, or a right-triangular shape in side view. Also, a shape that facilitates visual checking can be employed, depending on the required positional relationship of the core 34 and the end portion of the covering cylindrical body.

Also, the dimension L1 in the lengthwise direction of the positioning protrusion 30 can be set as appropriate in a range that enables the core 34 to be reliably covered, taking into consideration factors such as the size of the coated wire 32 and the material of the covering cylindrical body.

Furthermore, a configuration may be adopted in which, instead of using the heat shrinkable tube 38 as the covering cylindrical body, the crimp portion 14 is sealed by a cylindrical molded component made of a synthetic resin that encloses the crimp portion 14 from the outside. Effects such as ease of positioning that are realized by the crimp terminal 10 of the present invention can likewise be enjoyed in the case of a cylindrical molded component, similarly to the case of the heat shrinkable tube 38.

What is claimed is:

1. A crimp terminal comprising:

a connecting portion that is conductively connected to an electrical connection target;

a crimp portion spaced from the connecting portion along an extension direction, the crimp portion having a core crimping portion that is fixed by crimping to a core of a coated wire; and a link extending along the extension direction between the connecting portion and the crimp portion, a positioning protrusion formed by two slits penetrating through the link and extending in the extension direction, the slits being separated from each other in a width direction orthogonal to the extension direction, an intermediate region sandwiched between the slits in the width direction being deformed to protrude on a side on which the core crimping portion protrudes, wherein the positioning protrusion has a peaked shape that protrudes most in a central section in the extension direction.

2. The crimp terminal of claim 1, wherein the positioning protrusion has a projecting height substantially equal to a diameter of the core of the coated wire.

3. The crimp terminal of claim 1, further comprising a heat shrinkable tube positioned over the crimp portion and the link.

4. A crimp terminal comprising:

a connecting portion that is conductively connected to an electrical connection target;

a crimp portion spaced from the connecting portion along an extension direction, the crimp portion having a core crimping portion that is fixed by crimping to a core of a coated wire; and a link extending along the extension direction between the connecting portion and the crimp portion, a positioning protrusion formed by two slits penetrating through the link and extending in the extension direction, the slits being separated from each other in a width direction orthogonal to the extension direction, an intermediate region sandwiched between the slits in the width direction being deformed to protrude on a side on which the core crimping portion protrudes, wherein the positioning protrusion is joined unitarily to the link at opposite ends in the extension direction.

5. The crimp terminal of claim 4, wherein the positioning protrusion has a peaked shape that protrudes most in a central section in the extension direction.

6. A waterproof termination, comprising:

a crimp terminal having connecting portion configured for conductive connection to an electrical connection target, a crimp portion spaced from the connecting portion along an extension direction and having core crimping pieces protruding in a first direction from one surface of the crimp portion, and a link extending along the extension direction between the connecting portion and the crimp portion, a positioning protrusion formed by two slits penetrating through the link and extending in the extension direction, the slits being separated from each other in a width direction orthogonal to the extension direction, an intermediate region between the slits in the width direction being deformed to protrude in the first direction;

a wire having an end and a core exposed at the end, the end of the wire abutting against a surface of the positioning protrusion facing toward the crimp portion the core being engaged by the core crimping pieces;

a heat shrinkable tube positioned over the crimp portion and the link and at least a part of the wire engaged by the core crimping pieces; and a hot melt adhesive inward of the heat shrinkable tube and surrounding the positioning protrusion.

7. The waterproof termination of claim 6, wherein the heat shrinkable tube engages a surface of the positioning protrusion facing the connecting portion.

8. The waterproof termination of claim 6, wherein the positioning protrusion has a peaked shape that protrudes most in a central section in the extension direction.

9. The waterproof termination of claim 6, wherein the positioning protrusion is joined unitarily to the link at opposite ends in the extension direction.

10. The waterproof termination of claim 6, wherein the positioning protrusion has a projecting height substantially equal to a diameter of the core of the coated wire.

11. The waterproof termination of claim 6, wherein a length of the positioning protrusion in the extension direction exceeds a distance between the positioning protrusion and core crimping pieces.

* * * * *